US011316296B2

(12) United States Patent
Song et al.

(10) Patent No.: US 11,316,296 B2
(45) Date of Patent: Apr. 26, 2022

(54) MINIATURIZED CONNECTOR

(71) Applicant: DONGGUAN LUXSHARE TECHNOLOGIES CO., LTD, Dongguan (CN)

(72) Inventors: Tao Song, Dongguan (CN); Chenhui Zeng, Dongguan (CN); Kaide Wang, Dongguan (CN)

(73) Assignee: DONGGUAN LUXSHARE TECHNOLOGIES CO., LTD., Dongguan (CN)

( * ) Notice: Subject to any disclaimer, the term of this patent is extended or adjusted under 35 U.S.C. 154(b) by 0 days.

(21) Appl. No.: 17/084,043

(22) Filed: Oct. 29, 2020

(65) Prior Publication Data

US 2021/0336367 A1 Oct. 28, 2021

(30) Foreign Application Priority Data

Apr. 24, 2020 (CN) ..... 202010335780.0

(51) Int. Cl.

| | |
|---|---|
| ***H01R 13/40*** | (2006.01) |
| ***H01R 13/05*** | (2006.01) |
| ***H01R 13/24*** | (2006.01) |
| ***H01R 13/502*** | (2006.01) |

(52) U.S. Cl.

CPC ..... *H01R 13/40* (2013.01); *H01R 13/055* (2013.01); *H01R 13/2407* (2013.01); *H01R 13/502* (2013.01)

(58) Field of Classification Search

CPC .. H01R 13/5205; H01R 13/504; H01R 43/18; H01R 43/005

See application file for complete search history.

(56) References Cited

U.S. PATENT DOCUMENTS 2,619,515 A * 11/1952 Doane ..... H01R 13/4536 439/274
4,865,558 A * 9/1989 Stoner ..... H01R 13/6315 439/246
5,632,655 A * 5/1997 DeMarco, Jr. ..... H01R 13/42 439/598

(Continued)

FOREIGN PATENT DOCUMENTS

CN 2807263 Y 8/2006
CN 201450172 U 5/2010

(Continued)

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

Disclosed is a connector including an insulating body assembly and a plurality of terminal assemblies arranged side by side. Each of the plurality of terminal assemblies includes a connecting terminal and a contact terminal. The connecting terminal is disposed in the insulating body assembly, and a front end of the contact terminal is exposed to the insulating body assembly. A portion adjacent to the tail end of the contact terminal is provided with an accommodating hole a front end of the connecting terminal is inserted into the accommodating hole, and the front end of the connecting terminal is in elastic contact with an inner wall of the accommodating hole and is configured to move in the accommodating hole.

11 Claims, 8 Drawing Sheets

(56) References Cited

U.S. PATENT DOCUMENTS

| | | | | |
|---|---|---|---|---|
| 6,033,247 | A * | 3/2000 | Gregory, II | H01R 13/6315 439/247 |
| 6,077,128 | A | 6/2000 | Maag et al. | |
| 6,116,945 | A * | 9/2000 | Davis | H01R 13/5825 439/354 |
| 6,290,512 | B1 * | 9/2001 | Mullen, Jr. | H01R 13/506 439/106 |
| 7,785,153 | B2 * | 8/2010 | Wang | H01R 13/506 439/668 |
| 8,573,983 | B2 * | 11/2013 | Zieder | H01R 11/09 439/8 |
| 8,888,535 | B2 * | 11/2014 | Knight | H01R 13/5221 439/650 |
| 2008/0057745 | A1 | 3/2008 | Seo et al. | |
| 2015/0280356 | A1 * | 10/2015 | Jove Albos | H01R 13/5202 439/587 |
| 2019/0027855 | A1 * | 1/2019 | Dai | H01R 13/665 |

FOREIGN PATENT DOCUMENTS

| | | | |
|---|---|---|---|
| CN | 202423597 | U | 9/2012 |
| CN | 103311708 | A | 9/2013 |
| CN | 206976646 | U | 2/2018 |
| CN | 208674423 | U | 3/2019 |
| CN | 110729584 | A | 1/2020 |
| TW | M376958 | U1 | 3/2010 |

* cited by examiner

MINIATURIZED CONNECTOR

CROSS-REFERENCE TO RELATED APPLICATION(S)

This application claims priority to Chinese Patent Application No. 202010335780.0 filed Apr. 24, 2020, the disclosure of which is incorporated herein by reference in its entirety.

TECHNICAL FIELD

The present disclosure relates to the technical field of connectors and, in particular, to a connector.

BACKGROUND

At present, there are connecting methods, such as crimping fisheye, welding and elastic contact, for a cable to connect to a Printed circuit board (PCB). A method of elastic contact is that a portion of a contact terminal of a connector exposed to an insulating body is bent, and the bent portion abuts against the PCB to achieve the connection between the cable and the PCB through the connector.

The bent portion is usually bent into a semi-circular arc shape, and the contact terminal is configured to protrude toward one side, occupying a large space and resulting in a small number of contact terminals arranged on a connector. If a relatively large amount of signals need to be transmitted, a relatively large amount of contact terminals need to be set, which increase a volume of the connector and is not in line with development requirements of miniaturization of the connector.

SUMMARY

The present disclosure provides a connector, which does not need to bend a portion exposed outside an insulating body assembly, thereby reducing a space occupied by a contact terminal.

The connector includes an insulating body assembly and a plurality of terminal assemblies arranged side by side, where each of the plurality of terminal assemblies includes a connecting terminal and the contact terminal.

The connecting terminal is disposed in the insulating body assembly.

A tail end of the contact terminal is disposed in the insulating body assembly and a front end exposed to the insulating body assembly, where a portion adjacent to the tail end of the contact terminal is provided with an accommodating hole, a front end of the connecting terminal is inserted into the accommodating hole, and the front end of the connecting terminal is in elastic contact with an inner wall of the accommodating hole and is configured to move in the accommodating hole.

The insulating body assembly includes a first insulating block, an elastic member, and a second insulating block.

A middle portion adjacent to a tail end of the connecting terminal is disposed in the first insulating block, the tail end of the contact terminal is disposed in the second insulating block, the elastic member is disposed between the first insulating block and the second insulating block, the elastic member is provided with an escape hole, and a portion of the connecting terminal located between the first insulating block and the second insulating block is within the escape hole.

The connecting terminal includes a connecting portion and at least two elastic arms disposed at a front end of the connecting portion, where two adjacent elastic arms are disposed at an interval, at least a front end of each of the at least two elastic arms is configured to stick into the accommodating hole, a contact protrusion is disposed at an outer side of the front end of each of the at least two elastic arms, and the contact protrusion abuts against the inner wall of the accommodating hole.

The connecting terminal has a tubular shape, the at least two elastic arms are two elastic pieces arranged symmetrically, and each of the two elastic pieces has an arc-shaped section.

A connecting protrusion is circumferentially disposed on an outer side of a portion of the connecting portion located in the first insulating block.

A cable is further included, where a tail end of the connecting portion has a connecting hole, and a core wire at one end of the cable sticks into the connecting hole.

A third insulating block is further included and disposed at one side of the first insulating block facing away from the elasticity member, and the third insulating block covers an outer side of the tail end of the connecting portion and one end of the cable connected to the connecting terminal.

The connecting terminal has a long-strip sheet shape, and the at least two elastic arms are two elastic rods arranged symmetrically.

The connecting terminal has a long-strip sheet shape, an elliptical through hole is disposed at the front end of the connecting terminal, and a long axis of the ellipse is located at a length direction of the connecting terminal, portions of the connecting terminal located on two sides of the through hole protrude outward to form contact protrusions, the front end of the connecting terminal sticks into the accommodating hole of the contact terminal, and the contact protrusion abuts against the inner wall of the accommodating hole.

The elastic member is an elastic insulating block or a spring.

The contact terminal has a tubular shape, and the front end of the contact terminal has a spherical surface.

The present disclosure provides a connector, the front end of the connecting terminal is in elastic contact with the inner wall of the accommodating hole, so that the connecting terminal keeps in contact with the contact terminal, thereby effectively avoiding a phenomenon of poor contact. When the connector is connected to a PCB, after the contact terminal is in contact with a contact portion of the PCB, the contact terminal may move toward the connecting terminal under a rebound force, so that the contact terminal abuts against the PCB without damaging the PCB. The contact terminal is contracted by moving toward the connecting terminal, instead of being bent and contracted by elastic deformation. Therefore, there is no need to bend the portion exposed outside the insulating body assembly, merely to make the portion of the contact terminal exposed the insulating body assembly disposed vertically, which can reduce the space occupied by the contact terminal without increasing a volume of the connector. Therefore, more terminal assemblies can be disposed in a limited space of the connector, which is in line with development requirements of miniaturization of the connector.

REFERENCE LIST

Figure 1:
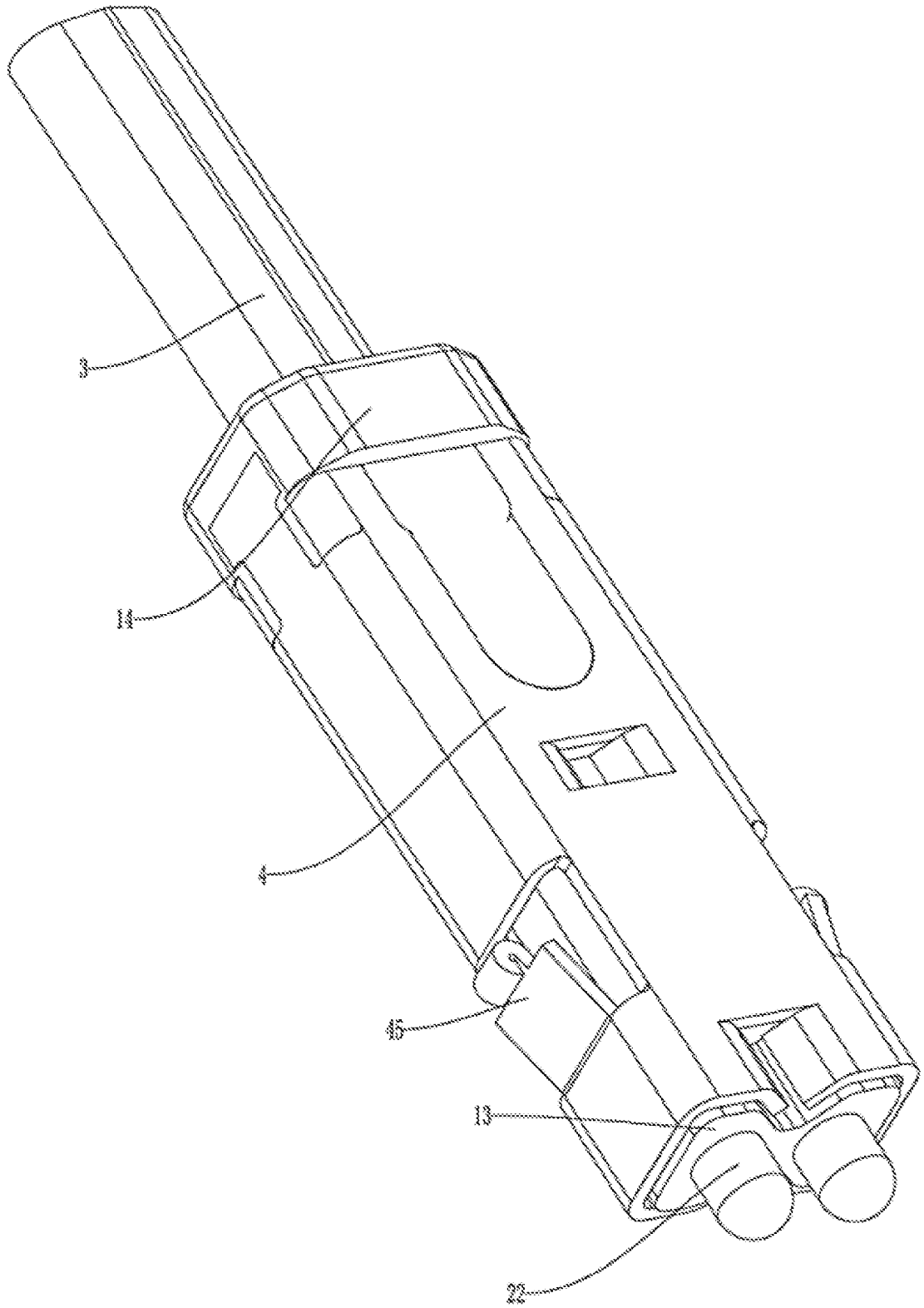
FIG. 1 is a structure view illustrating a connector according to embodiment one of the present disclosure.

1 insulating body assembly
11 first insulating block
111 second clamping groove
12 elastic member
121 escape hole
13 second insulating block
131 third clamping groove
14 third insulating block
141 first clamping groove
142 clamping protrusion
2 terminal assembly
21 connecting terminal
211 connecting portion
2111 connecting protrusion
2112 bell mouth
2113 connecting hole
2114 bending portion
212 elastic piece
2121 contact protrusion
213 elastic rod
22 contact terminal
221 accommodating hole
3 cable
31 connecting wire
4 metal housing
41 clamping portion
42 clamping hole
43 first elastic protrusion
44 second elastic protrusion
45 elastic clamping piece

DETAILED DESCRIPTION

The technical solution of the present disclosure will be described clearly and completely in conjunction with drawings. It is to be noted that similar reference numerals and letters indicate similar items in the subsequent drawings, and therefore, once a particular item is defined in a drawing, the item needs no more definition and explanation in subsequent drawings.

In the description of the present disclosure, it is to be noted that the orientational or positional relationships indicated by terms "above", "below", "left", "right", "vertical", "horizontal", "inside", "outside" and the like are based on the orientational or positional relationships illustrated in the drawings or the orientational or positional relationship that products of the present disclosure are usually used in, which are for the mere purpose of facilitating and simplifying the description of the present disclosure and do not indicate or imply that the apparatus or element referred to has a specific orientation and is constructed and operated in a specific orientation, and thus it is not to be construed as limiting the present disclosure. Moreover, terms "first", "second" and "third" are merely for distinguishing the description and are not to be construed as indicating or implying relative importance. In the description of the present disclosure, unless otherwise noted, "a plurality of" means two or more.

In the description of the present disclosure, it is further to be noted that, unless otherwise expressly specified and limited, terms "dispose" and "connection" should be understood in a broad sense, for example, may be a secured connection, a detachable connection or an integrated connection, or may be a mechanical connection or an electrical connection. For those skilled in the art, the preceding terms can be construed depending on specific contexts.

In the present disclosure, unless otherwise expressly specified and limited, when a first feature is described as "above" or "below" a second feature, the first feature and the second feature may be in direct contact or be in contact via another feature between the two features. Moreover, when the first feature is described as "on", "above" or "over" the second feature, the first feature is right on, above or over the second feature or the first feature is obliquely on, above or over the second feature, or the first feature is simply at a higher level than the second feature. When the first feature is described as "under", "below" or "underneath" the second feature, the first feature is right under, below or underneath the second feature or the first feature is obliquely under, below or underneath the second feature, or the first feature is simply at a lower level than the second feature.

The embodiments of the present disclosure are described in detail below, and examples of the embodiments are illustrated in the drawings, where the same or similar reference numerals indicate the same or similar elements or elements having the same or similar functions.

Embodiment One

Figure 2:
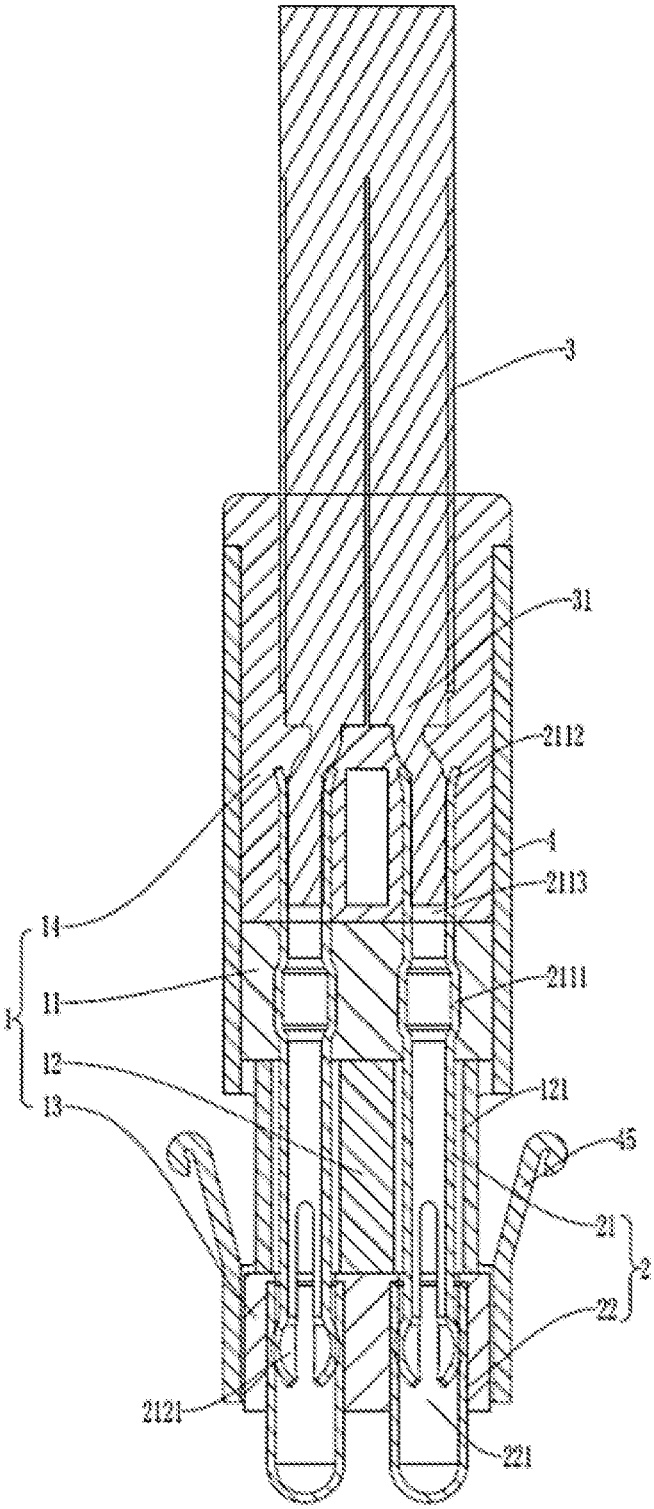
FIG. 2 is a cross-sectional view illustrating the connector according to embodiment one of the present disclosure.
Figure 3:
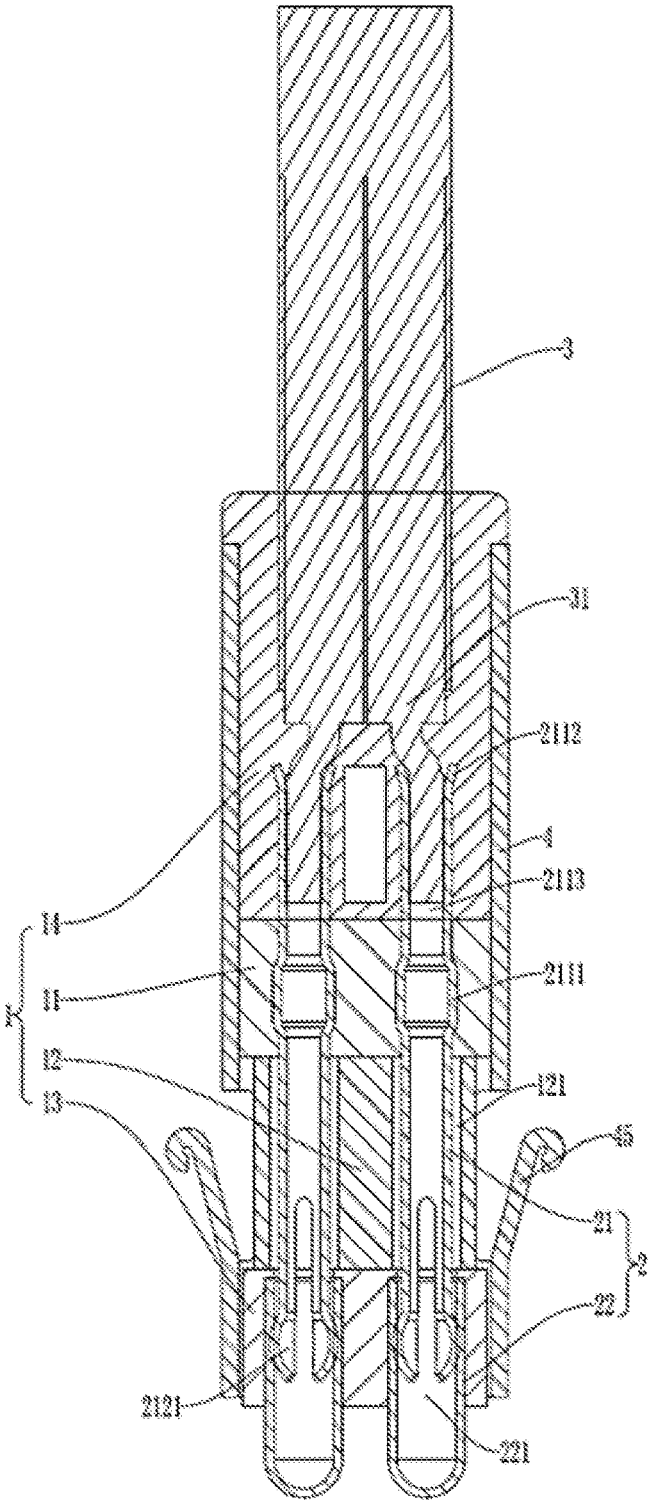
FIG. 3 is a partial structure view, where an elastic member is an elastic insulating block, illustrating the connector according to embodiment one of the present disclosure.

As shown in FIGS. 1 to 3, a connector includes an insulating body assembly 1 and a plurality of terminal assemblies 2 disposed side by side. Optionally, two terminal assemblies 2 are provided in the present embodiment. The terminal assembly 2 includes a connecting terminal 21 and a contact terminal 22. The connecting terminal 21 is disposed in the insulating body assembly 1, a tail end of the contact terminal 22 is disposed in the insulating body assembly 1, and a front end of the contact terminal 22 is exposed to the insulating body assembly 1. An accommodating hole 221 is disposed at a portion adjacent to the tail end of the contact terminal 22, the contact terminal 22 is sleeved to a front end of the connecting terminal 21, a sleeving length is adjustable, and the front end of the connecting terminal 21 is in elastic contact with an inner wall of the accommodating hole 221. The upper ends of the connecting terminal 21 and contact terminal 22 shown in FIG. 2 are defined as the tail end of the connecting terminal 21 and the tail end of the contact terminal 22, respectively. The lower ends of the connecting terminal 21 and contact terminal 22 shown in FIG. 2 are defined as the front end of the connecting terminal 21 and the front end of the contact terminal 22, respectively.

The front end of the connecting terminal 21 is in elastic contact with the inner wall of the accommodating hole 221, so that the connecting terminal 21 keeps in contact with the contact terminal 22, thereby effectively avoiding a phenomenon of poor contact. When the connector is connected to a PCB (not shown in the figure), after the contact terminal 22 is in contact with a contact portion of the PCB, the contact terminal 22 may move toward the connecting terminal 21 under a rebound force, so that the contact terminal 22 abuts against the PCB without damaging the PCB. The contact terminal 22 is contracted by moving toward a direction of the connecting terminal 21, instead of being bent and contracted by elastic deformation. Therefore, there is no need to bend a portion exposed outside the insulating body assembly 1, merely to make a portion of the contact terminal 22 exposed outside the insulating body assembly 1 disposed vertically, which can reduce a space occupied by the contact terminal 22 without increasing a volume of the connector. Therefore, more terminal assemblies can be disposed in a limited space of the connector, which is in line with development requirements of miniaturization of the connector.

With continued reference to FIG. 2, optionally, the contact terminal 22 has a tubular shape, and a front end of the contact terminal 22 has a spherical surface. A contact surface between the spherical surface and the PCB is small, so that the contact portion of the PCB is not excessively worn.

Specifically, with reference to FIGS. 2 and 3, the insulating body assembly 1 includes a third insulating block 14, a first insulating block 11, an elastic member 12 and a second insulating block 13 which are connected in sequence. A middle portion adjacent to a tail end of the connecting terminal 21 is disposed in the first insulating block 11, a connecting protrusion 2111 is circumferentially disposed on a portion of the connecting portion located in the first insulating block 11, and the first insulating block 11 may be firmly fixed on the connecting terminal 21 without displacement.

The tail end of the contact terminal 22 is disposed in the second insulating block 13, the second insulating block 13 is formed with an accommodating hole, and the tail end of the contact terminal 22 is located in the accommodating hole. The accommodating hole protrudes inwardly to form a first stop protrusion, and the first stop protrusion abuts against the tail end of the contact terminal 22.

Figure 4:
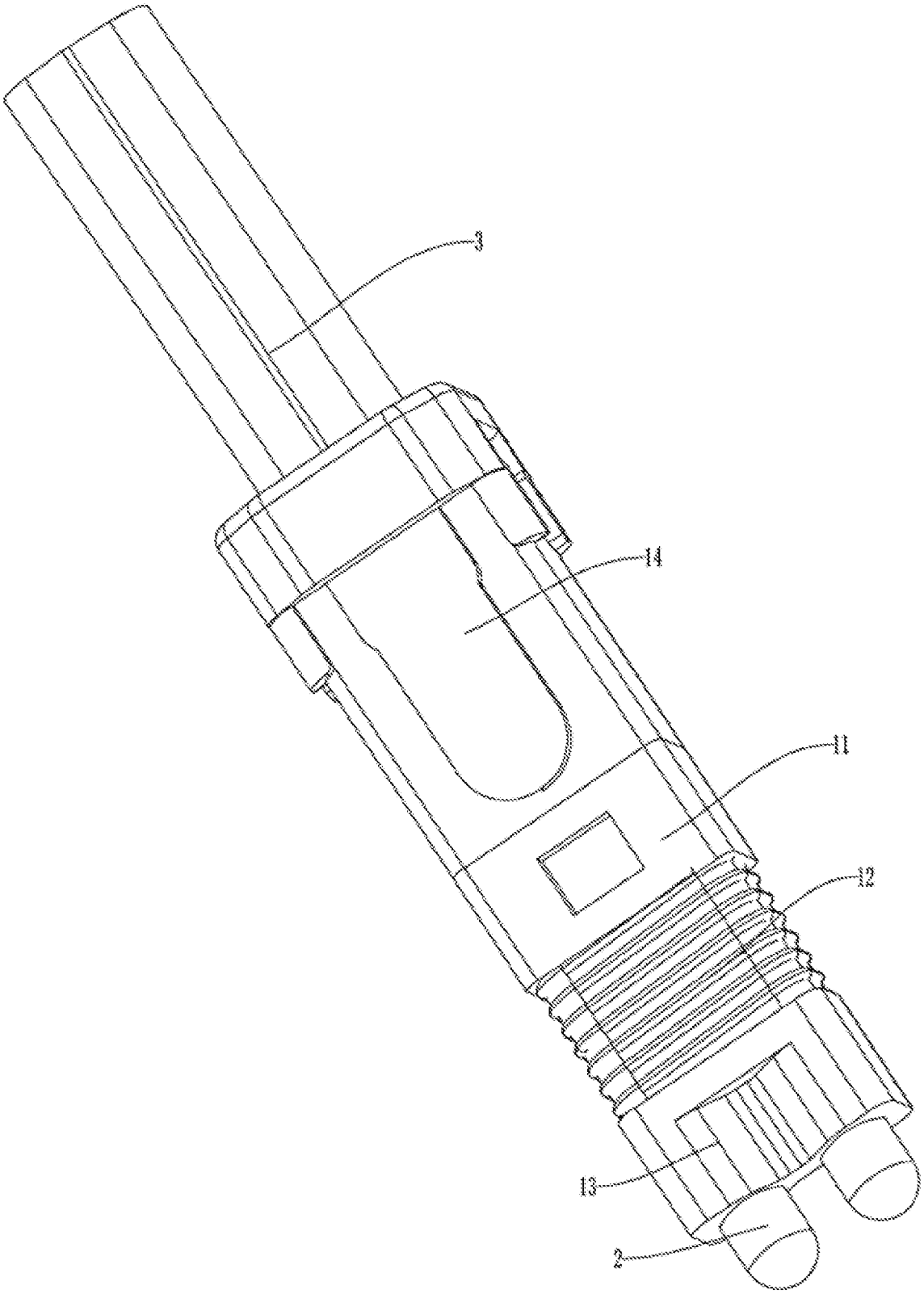
FIG. 4 is a partial structure view, where the elastic member is a spring, illustrating the connector according to embodiment one of the present disclosure.

The elastic member 12 is disposed between the first insulating block 11 and the second insulating block 13, and is provided with the escape hole 121, and a portion of the connecting terminal 21 located between the first insulating block 11 and the second insulating block 13 is located in the escape hole 121. Optionally, the elastic member 12 in the present embodiment is an elastic insulating block, a material of which is silicone gel, and in other embodiments, the elastic member 12 may also be other insulating materials with elasticity. In other embodiments, as shown in FIG. 4, the elastic member 12 is a spring sleeved on an outer side of the connecting terminal 21, and an outer diameter of the spring is relatively large, which is similar to an outer contour of the second insulating block 13. After a housing is sleeved on each outer side of the first insulating block 11, the elastic member 12 and the second insulating block 13, the housing is configured to limit the spring, so that the spring is not in contact with the connecting terminal 21. Optionally, a material of the spring in the present embodiment is silicone gel or rubber, and in other embodiments, the material of the spring may be metal.

When abutted against a contact portion of the PCB, the contact terminal 22 is subject to a rebound force, and the second insulating block 13 moves toward the first insulating block 11 under the rebound force of the contact terminal 22. The first insulating block 11 and the second insulating block 13 are configured to compress the elastic member 12, and the elastic member 12 is configured to exert an elastic force on the second insulating block 13. The elastic force is applied on the contact terminal 22, so that the contact terminal 22 is abutted against the contact portion of the PCB, so that the contact terminal 22 keeps in contact with the PCB, thereby avoiding a phenomenon of poor contact. An inner diameter of the escape hole 121 is greater than an outer diameter of the middle portion of the connecting terminal 21. When the elastic member 12 is deformed under pressure, a gap between the escape hole 121 and the connecting terminal 21 enables the elastic member 12 to be compressed smoothly.

Figure 5:
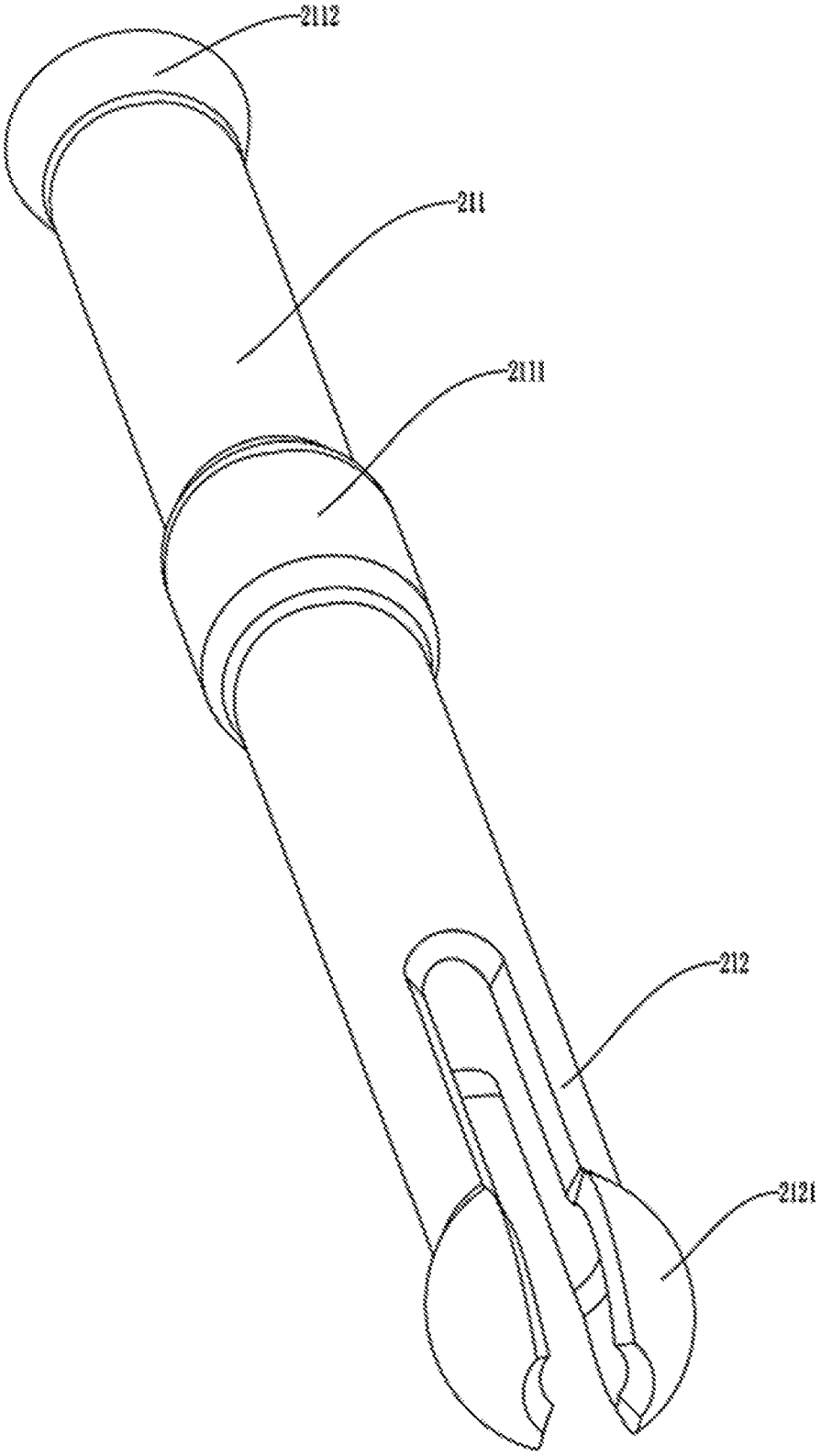
FIG. 5 is a structure view illustrating a connecting terminal according to embodiment one of the present disclosure.
Figure 6:
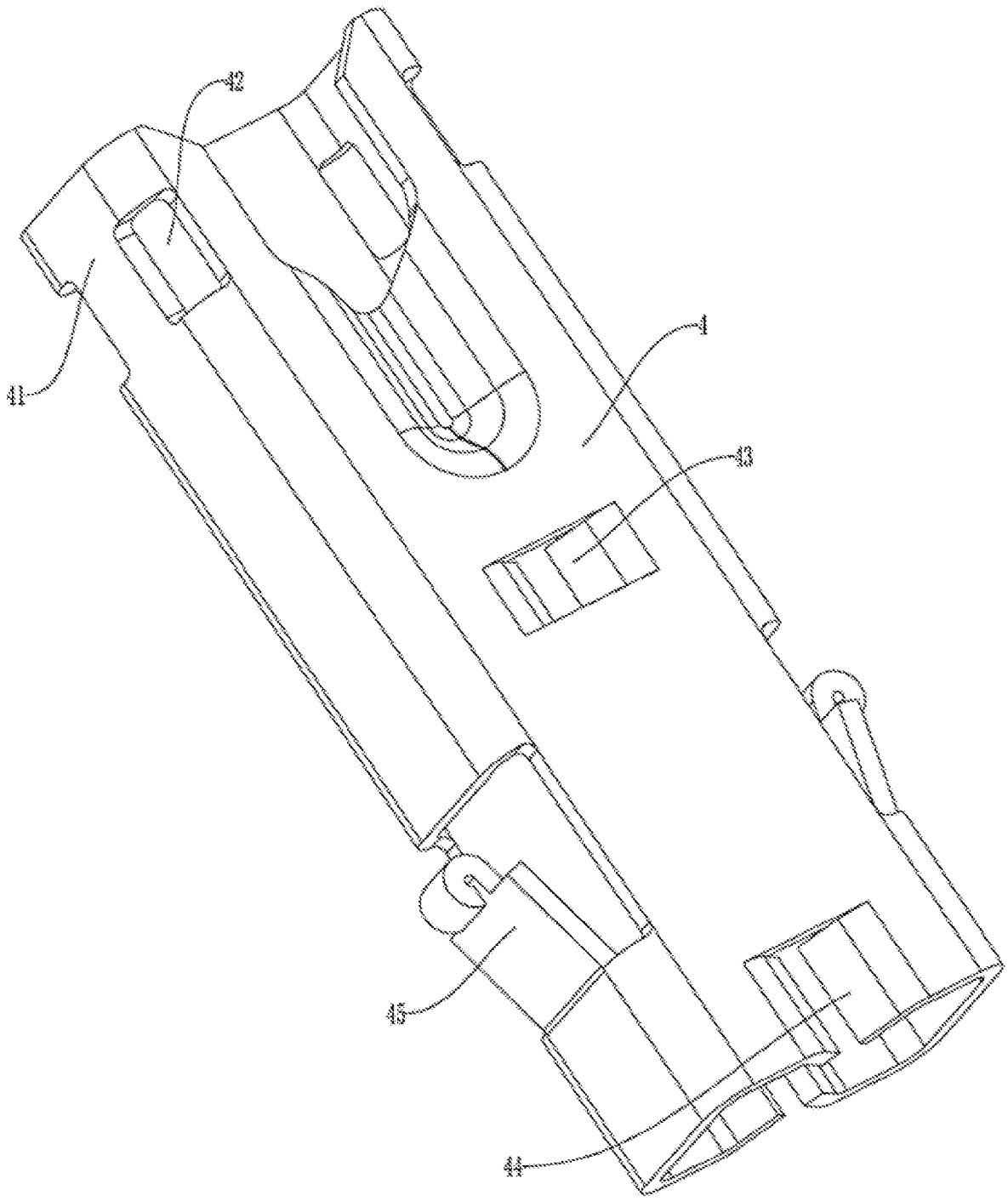
FIG. 6 is a structure view illustrating a metal housing according to embodiment one of the present disclosure.

As shown in FIGS. 2 and 5, the connecting terminal 21 includes a connecting portion 211 and at least two elastic arms disposed at a front end of the connecting portion 211. The two adjacent elastic arms are disposed at an interval, and at least a front end of each of the at least two elastic arms extends into the accommodating hole 221. A contact protrusion 2121 is disposed on an outer side of the front end of the elastic arm, and abuts against the inner side wall of the accommodating hole 221. With reference to FIGS. 2 and 5, in the present embodiment, the connecting terminal 21 has a tubular shape, and the at least two elastic arms are two symmetrically arranged elastic pieces 212 with an arc-shaped section. The number of the elastic pieces 212 is determined according to specific use requirements. The contact protrusion 2121 may ensure that while protruding into the accommodating hole 221, the front end of the connecting terminal 21 may also contact with the inner wall of the accommodating hole 221, the elastic piece 212 may ensure that the contact protrusion 2121 is in elastic contact with the inner wall of the accommodating hole 221, and when moving relative to the connecting terminal 21, the contact terminal 22 may also ensure that the contact protrusion 2121 keeps in contact with the inner wall of the accommodating hole 221, thereby effectively avoiding the phenomenon of poor contact.

With reference to FIGS. 1 to 3, the connector further includes a cable 3 that includes a same number of connecting wires 31 as the terminal assemblies 2, and each of the connecting wires 31 is connected to a tail end of each of the connecting terminals 21. The connecting portion 211 has a connecting hole 2113 at the tail end, and a core wire of the connecting wire 31 of the cable 3 connected to one end of the connecting terminal 21 extends into the connecting hole 2113. Specifically, the connecting portion 211 of the connecting terminal 21 also has a tubular shape, and the tail end of the connecting portion 211 has a bell mouth 2112, facilitating the core wire of the connecting wire 31 to be inserted into the connecting hole 2113. The bell mouth 2112 may be clamped and contracted after the core wire of the connecting wire 31 is inserted into the connecting hole 2113, so as to fix the core wire to the tail end of the connecting terminal 21. The third insulating block 14 is disposed at one side of the first insulating block 11 facing away from the elastic member 12. The third insulating block 14 covers an outer side of one end of the cable 3 connected to the connecting terminal 21 and an outer side of the tail end of the connecting portion 211, so that adjacent connecting wires 31 are insulated and isolated, and the cable 3 is fixed.

Optionally, with reference to FIGS. 1 to 3 and 6, the connector further includes a metal housing 4 covering an outer side of the insulating body assembly 1, and the metal housing 4 is fixed to the first insulating block 11, the second insulating block 13, and the third insulating block 14. A first clamping groove 141 and a clamping protrusion 142 are disposed on the third insulating block 14. The metal housing 4 is provided with a clamping portion 41 that cooperates with the first clamping groove 141, and a clamping hole 42 that cooperates with the clamping protrusion 142. After the metal housing 4 covers the third insulating block 14, the first clamping groove 141 and the clamping portion 41 cooperate with each other, and the clamping protrusion 142 and the clamping hole 42 cooperate with each other, so that the metal housing 4 is fixed on the first insulating block 11 without displacement. A second clamping groove 111 is disposed on the first insulating block 11, a first elastic protrusion 43 is stamped and formed on the metal housing 4, and the first elastic protrusion 43 extends into the second clamping groove 111 to limit the metal housing 4. A third clamping groove 131 is disposed on the second insulating block 13, a second elastic protrusion 44 is stamped and formed on the metal housing 4, and the second elastic protrusion 44 extends into the third clamping groove 131 to limit the metal housing 4. A left side and a right side of the metal housing 4 are provided with an elastic clamping piece 45 located at an outer side of the elastic member 12, and the elastic clamping piece 45 is disposed toward a tail end of the connector.

Embodiment Two

The present embodiment provides a connector whose structure is basically the same as that of Embodiment one, except that structures of the connecting terminals are different.

Figure 7:
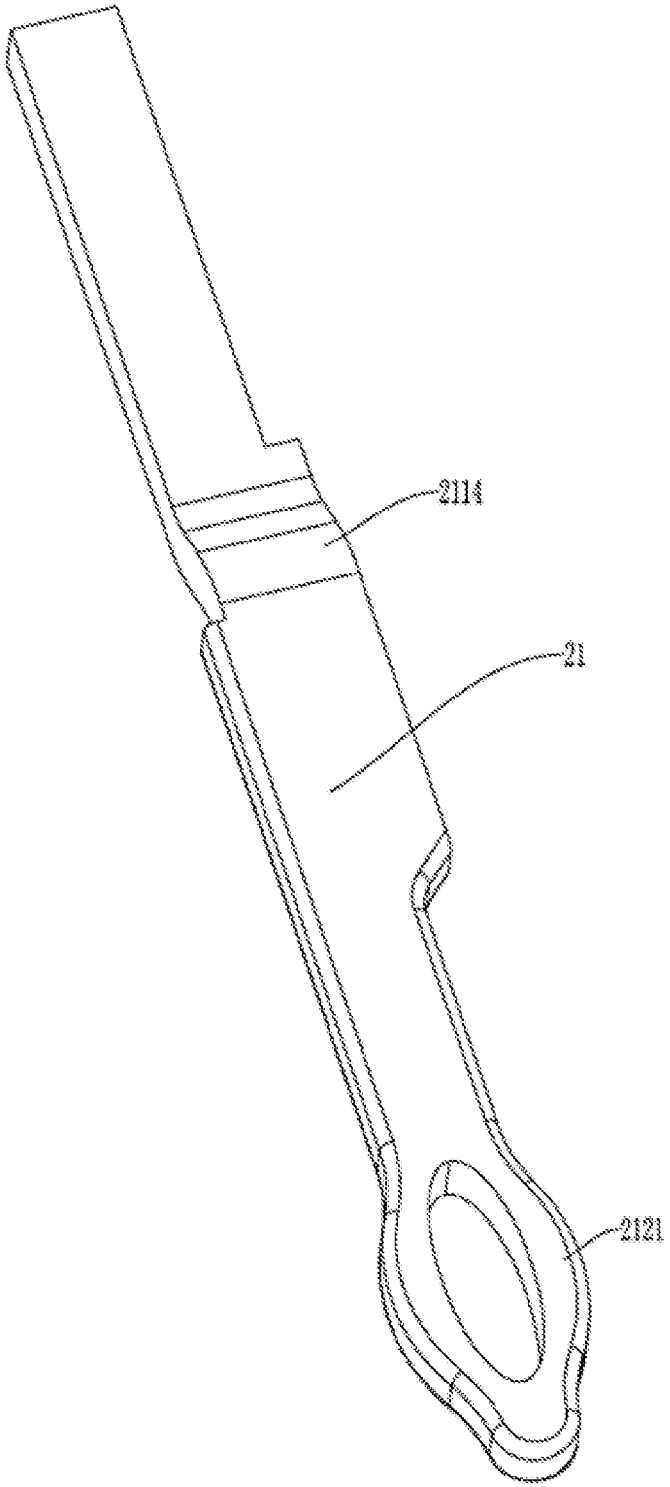
FIG. 7 is a structure view illustrating a connecting terminal according to embodiment two of the present disclosure.

As shown in FIG. 7, the connecting terminal 21 has a long-strip sheet shape, and a portion of the connecting terminal 21 located in the first insulating block 11 is bent to form a bending portion 2114, where the bending portion 2114 is located in the first insulating block 11 to avoid displacement between the connecting terminal 21 and the first insulating block 11. The front end of the connecting terminal 21 is stamped to form with an elliptical through hole, and a long axis of the ellipse is located in a length direction of the connecting terminal 21. Portions of the connecting terminal 21 located on two sides of the through hole protrude outward to form the contact protrusions 2121. When the front end of the connecting terminal 21 extends into the contact terminal 22, and the two contact protrusions 2121 abut against an inner wall of the contact terminal 22 to connect the contact terminal 22 and the connecting terminal 21. Moreover, when the contact terminal 22 moves relative to the connecting terminal 21, since a material of the connecting terminal 21 is metal, a certain elastic force is generated to overcome deformation of the two contact protrusions 2121 contract inward, so that the contact protrusion 2121 keeps in contact with the inner wall of the contact terminal 22, thereby effectively avoiding the phenomenon of poor contact.

Embodiment Three

The present embodiment provides a connector, whose structure is basically the same as that of Embodiment one, except that structures of the connecting terminals are different.

Figure 8:
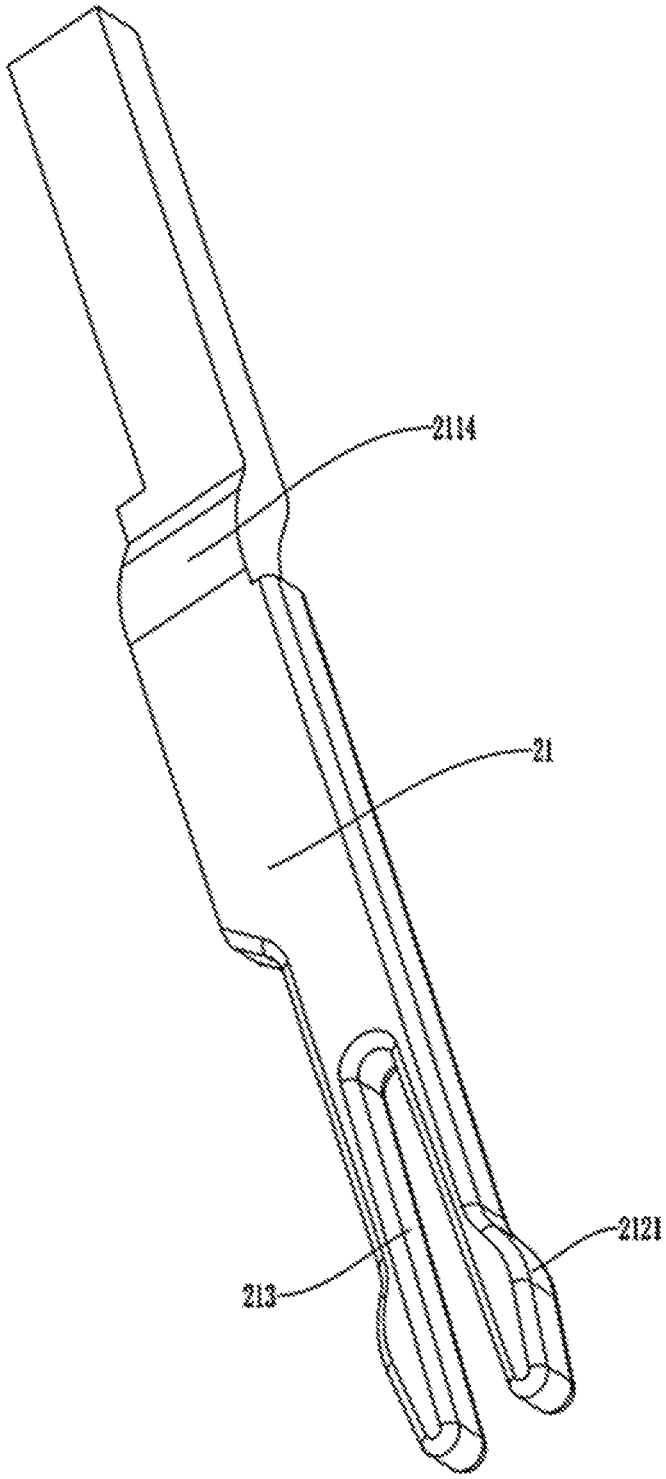
FIG. 8 is a structure view illustrating a connecting terminal according to embodiment three of the present disclosure.

As shown in FIG. 8, the connecting terminal 21 has a long-strip sheet shape, and a portion of the connecting terminal 21 located in the first insulating block 11 is bent to form a bending portion 2114, where the bending portion 2114 is located in the first insulating block 11 to avoid displacement between the connecting terminal 21 and the first insulating block 11.

In the present embodiment, the at least two elastic arms are two symmetrically arranged elastic rods 213, and the contact protrusion 2121 is disposed at an outer side of a front end of the elastic rod 213. When the front end of the connecting terminal 21 is inserted into the contact terminal 22, and the two contact protrusions 2121 abut against the inner wall of the contact terminal 22, such that the two elastic rods 213 are deformed, then the two elastic rods 213 have a certain elastic force to prevent the deformation. The elastic rod 213 may ensure that the contact protrusion 2121 is in elastic contact with the inner wall of the accommodating hole 221. When moving relative to the connecting terminal 21, the contact terminal 22 may also ensure that the contact protrusion 2121 keeps in contact with the inner wall of the accommodating hole 221, thereby effectively avoiding the phenomenon of poor contact.

What is claimed is:

1. A connector, comprising an insulating body assembly and a plurality of terminal assemblies arranged side by side, wherein each of the plurality of terminal assemblies comprises: a connecting terminal disposed in the insulating body assembly; and a contact terminal comprising a tail end disposed in the insulating body assembly and a front end exposed to the insulating body assembly, wherein a portion adjacent to the tail end of the contact terminal is provided with an accommodating note, a front end of the connecting terminal is inserted into the accommodating hole, and the front end of the connecting terminal is in elastic contact with an inner wall of the accommodating hole and is configured to move in the accommodating hole, wherein the insulating body assembly comprises a first insulating block, an elastic member, and a second insulating block; a middle portion adjacent to a tail end of the connecting terminal is disposed in the first insulating block, the tail end of the contact terminal is disposed in the second insulating block, the elastic member is disposed between the first insulating block and the second insulating block, the elastic member is provided with an escape hole, and a portion of the connecting terminal located between the first insulating block and the second insulating block is within the escape hole, wherein the connecting terminal comprises a connecting portion and at least two elastic arms disposed at a front end of the connection portion, wherein two adjacent elastic arms are disposed at an interval, at least a front end of each of the at least two elastic arms is configured to stick into the accommodating hole, a contact protrusion is disposed at an outer side of the front end of each of the at least two elastic arms, and the contact protrusion abuts against the inner wall of the accommodating hole.

2. The connector according to claim 1, wherein the connecting terminal has a tubular shape, the at least two elastic arms are two elastic pieces arranged symmetrically, and each of the two elastic pieces has an arc-shaped section.

3. The connector according to claim 2, wherein a connecting protrusion is circumferentially disposed on an outer side of a portion of the connecting portion located in the first insulating block.

4. The connector according to claim 2, further comprising a cable, wherein a tail end of the connecting portion has a connecting hole, and a core wire at one end of the cable sticks into the connecting hole.

5. The connector according to claim 4, wherein the insulating body assembly further comprises a third insulating block disposed at one side of the first insulating block facing away from the elasticity member, and the third insulating block covers an outer side of the tail end of the connecting portion and one end of the cable connected to the connecting terminal.

6. The connector according to claim 1, wherein the connecting terminal has a long-strip sheet shape, and the at least two elastic arms are two elastic rods arranged symmetrically.

7. The connector according to claim 1, wherein the connecting terminal has a long-strip sheet shape, an elliptical through hole is disposed at the front end of the connecting terminal, and a long axis of the ellipse is located at a length direction of the connecting terminal, portions of the connecting terminal located on two sides of the through hole protrude outward to form contact protrusions, the front end of the connecting terminal sticks into the accommodating hole of the contact terminal, and the contact protrusion abuts against the inner wall of the accommodating hole.

8. The connector according to claim 1, wherein the elastic member is an elastic insulating block or a spring.

9. The connector according to claim 1, wherein the contact terminal has a tubular shape, and the front end of the contact terminal has a spherical surface.

10. The connector according to claim 5, wherein the insulating body assembly further comprises a third insulating block disposed at one side of the first insulating block facing away from the elasticity member, and the third insulating block covers an outer side of the tail end of the connecting portion and one end of the cable connected to the connecting terminal.

11. The connector according to claim 7, wherein the insulating body assembly further comprises a third insulating block disposed at one side of the first insulating block facing away from the elasticity member, and the third insulating block covers an outer side of the tail end of the connecting portion and one end of the cable connected to the connecting terminal.

* * * * *